United States Patent [19]

Tehon

[11] 3,964,014

[45] June 15, 1976

[54] SONIC TRANSDUCER ARRAY

[75] Inventor: Stephen W. Tehon, Clay, N.Y.

[73] Assignee: General Electric Company, Syracuse, N.Y.

[22] Filed: Oct. 15, 1974

[21] Appl. No.: 514,617

[52] U.S. Cl. ..... 340/9; 340/5 MP; 340/10; 310/9.1

[51] Int. Cl.[2] ..... H04R 1/44; H04R 17/00

[58] Field of Search ..... 340/5 MP, 8 S, 9, 10; 310/9.1, 9.4

[56] References Cited

UNITED STATES PATENTS 3,230,503 1/1966 Elliot, Jr. et al. ..... 340/10

*Primary Examiner*—Richard A. Farley

*Attorney, Agent, or Firm*—Richard V. Lang; Carl W. Baker; Frank L. Neuhauser

[57] ABSTRACT

The present invention relates to a transducer array having a resolution suitable for imaging objects disposed in a liquid medium and illuminated with sonic energy of short wavelength. The array consists of a plurality of piezoelectric transducers sensing the sonic waves at their extremities and designed to produce corresponding electrical voltages suitable for image formation. While the individual transducers are fabricated from a common monolithic block, a geometry is used which reduces the coupling between the individual transducers. The individual transducers, which vibrate in a longitudinal mode with antinodes at either extremity and nodal regions at the center, are supported at their nodes by a thin web. The thin web then is the means for attaching the array to the frame of the apparatus. Central nodal support of the transducers minimizes stresses on the web from transducer vibration, reduces crosstalk, and improves the resolution of the array. Monolithic assembly permits large numbers of like transducers to be efficiently formed in an economical batch process.

10 Claims, 13 Drawing Figures

FIG.1
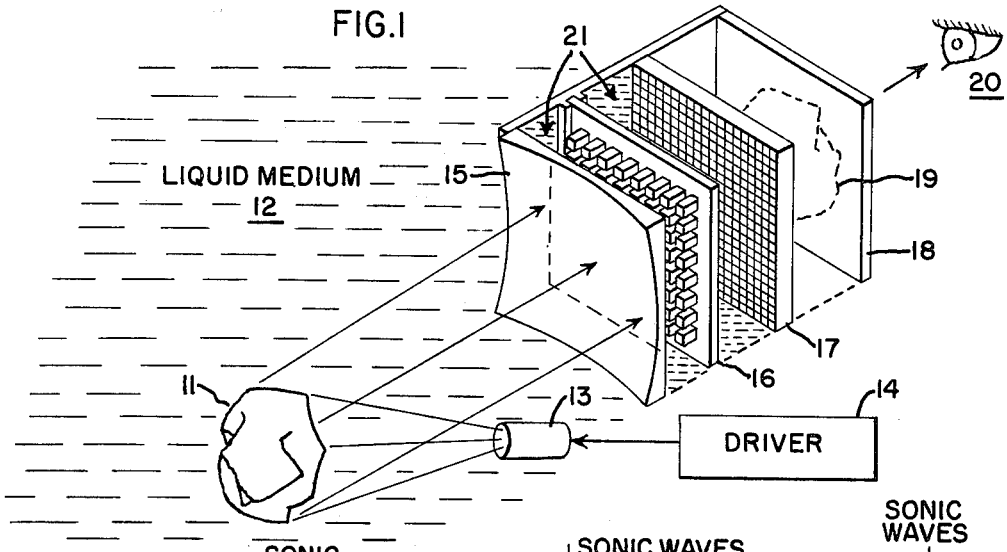
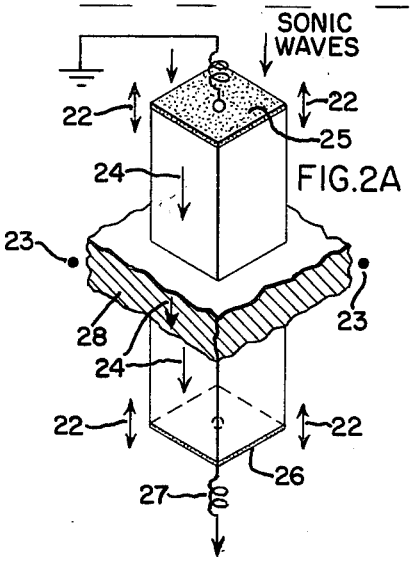
FIG.2A
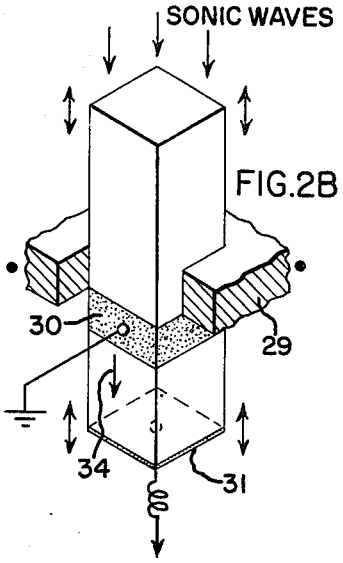
FIG.2B
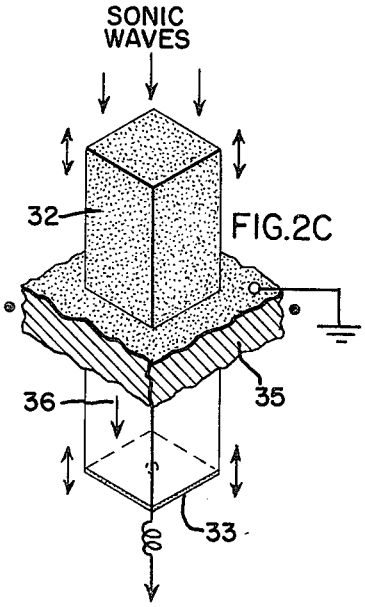
FIG.2C
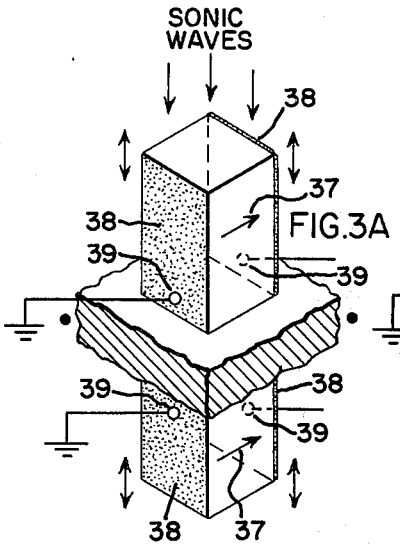
FIG.3A
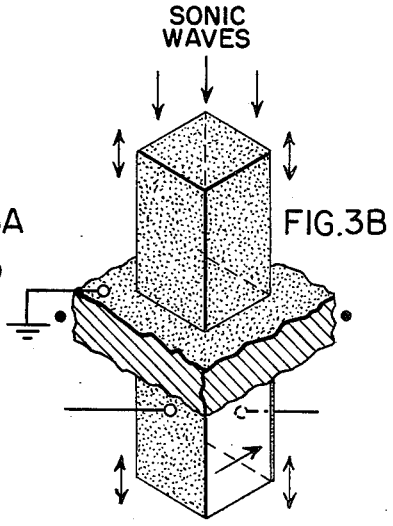
FIG.3B
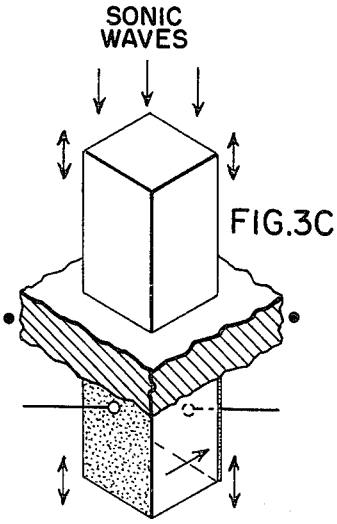
FIG.3C

SONIC TRANSDUCER ARRAY

BACKGROUND OF THE INVENTION

1. Field of the Invention

The present invention relates to ultrasonic imaging and more particularly to the formation of an area array of ultrasonic transducers which senses points of a sonic wavefront with adequate resolution to form a useful image. The arrays herein disclosed have application to the imaging of small objects such as are of interest in medical application as well as to the imaging of larger distant objects in a waterborne environment.

2. Description of the Prior Art

Ultrasonic imaging is of growing interest. Its two principal spheres of application are to medical electronics and to underwater viewing. In its medical application, ultrasonic imaging acts as a substitute and supplement to x-ray examination. It has the advantage that at the levels of ultrasonic energy normally required, the possibility of injury to the patient is remote. At the same time, ultrasonic examination supplements x-ray examination since it permits one to obtain information under conditions where x-radiation cannot be used. Normal ultrasonic examination relies on the relatively good contrasts which exist between body fluids, soft tissues and bone. In underwater applications, the ultrasonic viewing has the advantage of having greater water penetration than other forms of wave energy, and presents the possibility, not yet fully realized, of imaging objects with relatively high resolution at relatively great distances in the water.

While practical usage is going on in both of the foregoing applications, measured by the high performance standards set by x-radiation equipment in medical applications and high resolution radar systems for distant viewing, ultrasonic imaging systems are in a primitive stage. In medical applications, the principal mode of ultrasonically examining a sample is to use a single scanned transducer for both transmission and sensing. The information is then supplied to a storage tube in such a way as to create a slowly formed display of the area under examination. The system is usable but much less than optimum in relation to resolution and the speed by which images are recreated. Like limitations exist in underwater viewing operations.

A critical element in such ultrasonic imaging systems is the means by which the sonic fields are sensed in order to form an image. Scanned single transducers are in use and being refined. Arrays of large numbers of transducers have been proposed to take their place. That arrays, which would sense a large number of points in the sonic field simultaneously are preferable, is unquestioned. Arrays of transducers are used in sonar systems and analagous uses are being made of large numbers of elements in high resolution radar systems. In ultrasonic applications, the arrays presently known suffer from poor resolution and from constructional complexity. A primary problem has been the inability to assemble the individual transducers making an array with sufficient density to obtain all the information in the sonic field and at the same time decouple adjacent array elements. A second problem has been the prohibitive cost of making the large numbers of elements, which such arrays would normally require.

One known array for ultrasonic imaging has been described in the literature using resonant elements supported upon a rigid plate. These elements were designed to operate with their free ends as antinodes and their supports as nodes. In practice, there does not appear to be a truly rigid plate. The stresses occurring from unbalanced vibration of one resonator deform the plate and the plate couples the vibrations from one resonator to another. This coupling destroys the resolution that would otherwise be predictable from the design parameters.

SUMMARY OF THE INVENTION

Accordingly, it is an object of the present invention to provide an improved transducer array suitable for ultrasonic imaging.

It is still another object of the present invention to provide an array of ultrasonic transducers having improved resolution.

It is a further object of the present invention to provide an array of ultrasonic transducers which is simple to construct.

These and other objects of the present invention are achieved in a sonic transducer array for use in a liquid medium. It comprises a plurality of elongated piezoelectric transducers of substantially equal resonant frequency designed to vibrate in a longitudinal mode with an intermediate nodal region and antinodes at either end. The transducer further comprises support means including a thin, sheet-like web having a thickness of less than one-eighth wavelength which supports the transducers at their nodal regions. The individual transducers are spaced at typically half wavelength intervals to obtain all the significant information in the sonic wave field at the specified frequency. A frame attached to the web supports the transducers in place in the liquid medium. The antinodal regions of the transducers on one face of the array are coupled to the liquid medium for mechanical interaction and electrode means are provided for electrical interaction. For simplicity in fabrication, the web and the transducers are part of a monolithic piezoelectric member. For improved response, both faces of the array are immersed in liquid media having like mechanical loading properties. The electrode means comprises a thin conductive layer and a smaller electrical contact of unavoidably variable mass and variable elasticity. In one preferred form, mechanically coupled transducer halves are covered with a thin conductive layer to avoid external fields and to eliminate the need for individual contacts on these transducer halves that might interfere with sonic wave coupling. The electrode means are then piezoelectrically coupled to the transducer halves on the other face of the array.

The transducers of the array, in accordance with the invention, may be either longitudinally or transversely polarized. The thin conductive layers of the transversely polarized transducers may extend from an antinodal to a nodal region on the lateral surfaces of the transducer. This permits the contacts to the transversely polarized transducers to be placed at a nodal region or on the web, where they will have a minimum dispersive effect on the frequencies of the individual transducers.

BRIEF DESCRIPTION OF THE DRAWING

The novel and distinctive features of the invention are set forth in the claims appended to the present application. The invention itself, however, together with further objects and advantages thereof may best be understood by reference to the following description and accompanying drawings, in which:

FIG. 1 is a simplified drawing of an image forming system using a sonic transducer array in accordance with the invention;

FIGS. 2A, 2B and 2C are perspective drawings of three variant forms of transducers suitable for use in the array and characterized by longitudinal vibration and longitudinal polarization;

FIGS. 3A, 3B and 3C are perspective drawings of three other forms of sonic transducers suitable for use in the array and characterized by longitudinal vibration with the polarization orthogonal to the direction of vibration;

DESCRIPTION OF THE PREFERRED EMBODIMENTS

Figure 4A:
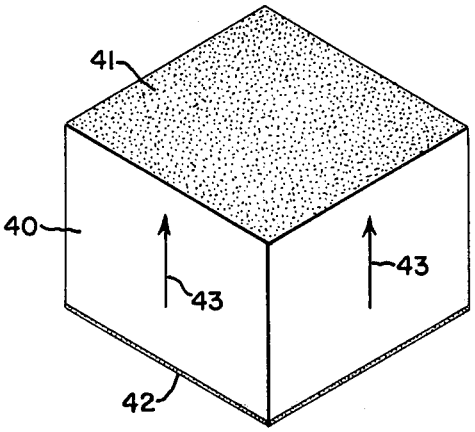
FIGS. 4A, 4B and 4C are figures illustrating the fabrication of an array of longitudinally polarized transducers.

A novel image forming system using a sonic transducer array in accordance with the invention is shown in FIG. 1. An object under examination is shown at 11, disposed in a liquid medium 12 and illuminated with ultrasonic vibrations from a sonic transmitter 13, powered by an electrical driver 14. Sonic waves scattered from the illuminated object are directed towards the image forming system, whose function is to convert the sonic energy into a visual image 19, observable by eye as shown at 20.

The image forming system which converts the sonci energy reflected from the object into a visible image comprises the elements 15, 16, 17 and 18. The first element of the system is an acoustic lens 15, whose front face is in contact with the liquid medium in which the object is disposed and whose back face is immersed in a liquid 21 which provides efficient sonic coupling with a transducer array 16 disposed behind the lens. To offset external pressures and provide balanced acoustic loading, both faces of the transducer array are also immersed in the liquid 21. The liquid 21 is sealed within the container for the image forming sytem. It is selected to have approximately the same acoustic impedance as water and for good insulating qualities so that the charges on any exposed conductors will not be dissipated. A suitable liquid is a product of the Minnesota Mining Corporation and bears the trade name "FLUORINERT". Assuming that the object of interest is at a greater than focal distance from the acoustic lens, an inverted real image of the object 11 will be formed in an image plane at a given distance from the back face of the acoustic lens.

The second element in the image forming system is the novel transducer array 16 disposed in the image plane of the acoustic lens. The function of the transducer array is to sense the acoustic wave intensity at an adequate number of points in the image plane of the acoustic lens to capture the available detail in the acoustic image, and then by virtue of piezoelectric action to convert the acoustic wave intensity at each point into an electric signal. Depending upon application, the transducers may be from 10 to several 100 in a row, the rows being formed into a rectangular array, with a total number of transducers of from 100 to in excess of 10,000. The transducer array thus consists of a suitably large number of independent transducers each resonating in a longitudinal mode and responding to the acoustic wave at each transducer location. Sonic wave coupling occurs on the array face immersed in the liquid 21 in response to vectors orthogonal to the exposed ends of the individual transducers. The transducers are a half wavelength in length having an antinodal region at either extremity, and a central nodal region. A supporting web affixed to this central nodal region, attaches the individual transducers to the framework of the apparatus in a manner permitting a high degree of transducer isolation. Portions of the surface of each transducer are suitably electroded to convert the mechanical vibrations into a voltage by piezoelectric action. The individual voltages are then coupled from each transducer to an amplifier in an integrated circuit array 17. For simplicity, these connections are not shown. The IC array 17 forms the third principal element of the image forming system.

The IC array 17 is formed on a thin insulating substrate having a plurality of spaced input electrode regions, each connected as noted above with an electrical output electrode from a corresponding transducer in array 16. One suitable contact method is by supporting the contacts of IC array 17 in light, resilient engagement with contacting surfaces on the back face of each transducer, the contact being designed to minimize mechanical loading of the transducer. Another contact method is to use a soldered or bonded contact at a nodal region where mechanical loading is negligible. When the connections are dense a preferred interconnection technique is to use printed circuit connections. They are printed on a succession of thin flexible circuit boards, assigned to each row of transducers and stacked in the numbers required for the total number of rows.

Each amplifier of the integrated circuit array 17 amplifies the individual electrical signals to the point where each provides a signal of adequate power to contral a light emitting diode. An array 18 of light emitting diodes forms the fourth and final element of the image forming sytem.

The LED array 18 contains a plurality of diodes each arranged to produce a light whose intensity is controlled by an IC amplifier responding to the sonic wave intensity sensed by a specific transducer element. The light emitting diodes may be individually wired into the IC array or assembled on a separate supporting substrate as shown. In either configuration, the diodes themselves are evenly spaced over a rectangularly bounded surface with the connections from the IC array being led directly to the individual diodes. The diodes are oriented to direct their light output toward the observer, shown at 20. (The artist's rendering of the image of the object as it would appear to the observer at 20 is shown at 19.) When the individual diodes are tightly packed, such as they would be in a high resolution array for medical applications, special provisions may be required for heat dissipation. Light emitting diodes are available, which may be assembled into a 2 inches × 2 inches array with 50 elements per inch. The heat output of such an array is then dependent upon the average level of the illumination. If high light intensities are desired for an array of this density, a heat conducting substrate and cooling means may be required. Where the light emitting diodes are less densely packed, the problem is less severe and normal conduction, air convection and radiation cooling may be quite adequate.

The foregoing image forming system may be used for both surface examinaton and internal viewing of an object. In the disposition of the transducer illustrated in FIG. 1, surface examination of the object may be assumed. Here the object is suspended in a liquid which has a different acoustic impedance from that of the object. Under this condition, the surface of the object provides a strong reflection of the illuminating sonic waves and the reflected sonic waves will form a picture of the object's surface. If the object has an acoustic impedance only slightly different from that of the liquid in which it is suspended, then less energy will be reflected at the surface and more will penetrate the object. One may then examine internal structures of the object in much the same way as X-radiation is used. Dependent upon application, one may place the sonic transducer in front of the object or to one side of the object or behind the object. When the sonic transducer is placed between the object and the image forming system, a silhouette containing internal information is formed. If the object has regions of higher sonic wave opacity than others, these will show up more darkly in a display. In the event there are large differences in the sonic impedances between different structures within the object, backward reflections will occur, reducing the forward wave transmission and locally reducing the brightness of the display.

The foregoing image forming system may be used to view both large and small objects in a liquid environment. The presence of the liquid environment makes for efficient sonic wave transmission to and from the object being examined. The system thus has application to undersea viewing where murky viewing conditions or light attenuation, which is greater than sonic wave attenuation at lower (<500 Khz) sonic frequencies, prevents optical viewing. In respect to the viewing of large underwater objects, such as other submarines, the transducer may be arranged in a suitable aperture in a submarine hull. In a smaller domain, the invention may be applied to the internal examination of animals and humans for medical purposes. In "non-invasive" medical examination, the different opacities and different acoustic impedances between bone structure, different classes of soft tissue and body fluids provide substantial contrasts, permitting one to derive considerable information from a sonic wave examination.

The foregoing image forming system may be scaled, depending upon application. Primary considerations are the imaging resolution and sonic wave penetration required. In the medical examinaton of internal organs of the human body, a resonator frequency of 2.25 megahertz producing a resolution of 1 cm and capable of penetrating the human body is conventional. For retinal examinations, requiring a finer 1 mm. resolution, but only a rew centimeters of tissue penetration, a 15 megahertz resonant frequency is conventional. If larger objects at a remote distance are of interest (swimmers, mines in water, etc.) and a limiting resolution of 6 inches is acceptable, the transducer frequency may be about 600 Khz. If 3 meter limiting resolution is acceptable, the transducer frequency may be 100 Khz. Since the lower frequencies are normally less attenuated, they are favored when resolution will permit.

Assuming a given resolution is sought, the spacing of the elements in the array is also predetermined. Sampling theory indicates that half or approximately half wavelength separations, measured at the wavelength of sound in the liquid medium, represents optimum spacing to achieve maximum resolution. In contrast, the transducer length, the ratio of length to cross dimensions, and the web thickness dimensions depends upon the acoustic wave properties of the transducer materials themselves. The values are selected to prevent extraneous modes, reduce cross talk, and other objectives.

The image forming system illustrated in FIG. 1 has been simplified in the depiction of the individual elements of the system. The transducer array is of particular interest since its design represents a substantial departure from that of arrays presently known. Functionally, the present transducer array represents a major improvement in respect both to resolution and ease of assembly. The improvement in resolution may be characterized as a reduction in crosstalk between adjacent and next adjacent transducers.

In monolithic assembly, large numbers of transducers may be made in an economical batch operation. The economies flow from the fact that the machining operations form common surfaces for a large number of transducers at a single setting and from the fact that the electroding and polarizing steps can be done on a large number of surfaces at the same time. A principal advantage of the present arrangement lies in the fact that while the individual transducers are formed as an integral part of the monolithic piezoelectric structure, they are substantially decoupled from a vibrational standpoint. The transducer array will be treated in further detail in the remaining portion of the present application.

With respect to the other elements of the system in FIG. 1, the acoustic lens 15 is most restrictive of performance. When the acoustic lens is of a plastic material and formed by a simple casting, adequate contour accuracy may be achieved but the material tends to be lossy and the two interfaces cause reflection losses. In the event that the acoustic lens is formed by a thin walled container using a fluid of different velocity from the other liquid media, attenuation losses are smaller, but the four interfaces increase the reflective losses. A second problem arising from the reflections is that they cause ghost images which are displaced in focus, arrival time and apparent position from the desired image and interfere with its interpretation.

In addition to the disadvantage of increased attenuation and ghosts, acoustic lensing is normally less flexible than a versatile holographic processor in selecting the image plane, the field of view, and the viewpoint. Where holographic processing of adequate capacity for image formation and special transformations is available, it replaces the lens 15 in the system of FIG. 1. In that event, the lens 15 is omitted so that the sonic waves impinge directly on the transducer array and permits both sonic wave intensity and phase information to be utilized. The holographic processor is then coupled to the output of the transducer array to convert the individual signals from the individual transducer elements into the desired image format suitable for application to the IC array 17.

Individual sonic transducers in the array depicted in FIG. 1 may fall into one of two principal groups. A first group of transducer elements is illustrated in FIGS. 2A, 2B and 2C. The three kinds of transducer elements in these figures have the common property of resonating in a longitudinal mode and of being polarized parallel to the longitudinal axis. The transducers illustrated in FIGS. 3A, 3B and 3C fall into a second group wherein the mechanical vibration is still in the longitudinal mode but the electrical polarization is transverse to the longitudinal axis. In the forms illustrated in FIGS. 2A, 2B and 2C and FIGS. 3A, 3B and 3C, the electroding is disposed to couple to the electrical fields in the direction of the polarization arrows. In the illustrated forms, the fundamental mode of vibration is a one-half wavelength londitudinal mode producing a nodal region at the center of the transducer with antinodal regions at either extremity.

In the longitudinal mode, the transducer may be regarded as being alternately stretched and compressed along its longitudinal axis as shown by the arrows 22. The elemental volumes of the extremities of the transducer experience the greatest displacements but undergo the least internal strains. On the other hand, the elemental volumes at the center of the transducer undergo the greatest internal strains, but experience the smallest displacements as shown by the dots 23, indicating negligible longitudinal motion. If the transducer is supported at an extremity, and assuming no redistribution of the resonant pattern, the center of gravity of the transducer will be displaced in respect to the support equal to the amount of the maximum displacement. This displacement of the center of gravity will cause a very substantial buffeting stress upon the support. If on the other hand, the transducer is supported at a nodal region, typically at the center of the bar, the center of gravity experiences no displacement and minimal buffeting of the support occurs. With precise positioning, the principal stressing of the support arises from the integrated strains bridged by the support. If the support is kept thin, these strains will be quite small.

Thus, assuming that the sonic illumination is at a given frequency, the physical length of the transducer elements is cut to approximately one-half the wavelength of a sonic wave of that frequency. The transducer elements may also operate on certain longitudinal overtones (one-half, three-halves, . . .

$$\frac{2n-1}{2}$$

(wavelengths, assuming a central nodal support). As will be detailed below, the array design suppresses other resonant modes such as thickness modes in the transducer or web. To suppress these modes, the cross-sectional dimensions of the individual transducers and the thickness of the web are kept to a small fraction of a sonic wavelength.

Referring again to FIGS. 2A, 2B and 2C, three longitudinally polarized transducer elements are shown. The transducer shown in FIG. 2A is polarized for its entire length in the direction of the arrows 24 and electrode means are applied to either extremity of the device at 25 and 26 respectively. Assuming that the electrode 25 is on the end of the transducer immersed in the liquid and exposed to the sonic waves, it may be conveniently electrically grounded. A piezoelectric potential is then developed along the length of the transducer at electrode 26 in respect to the initial grounded electrode 25. A resilient non-loading contact is shown schematicaly at 27. In practice, both the ground and ungrounded electrodes may require a resilient contact. A broken portion of the central supporting web to the transducer element is at 28. It is normally convenient for the polarization to extend through the web, even though it is of little significance in the operation of the finished device. The transverse dimensions of the transducer element are substantially less than length, typically being less than one-eighth wavelength. The thickness of the web should also be small, also less than one-eighth wavelength.

The second form of transducer element is shown in FIG. 2B. In FIG. 2B longitudinal polarization is required in the lower half of the device as shown at 34 but not in its upper half. The upper half of the resonator is unelectroded but exposed to sonic wave vibrations. Assuming light electrical loading in FIG. 2A, which is the usual case, the resonant pattern of the FIG. 2B configuration is identical to that of the FIG. 2A configuration. The central supporting web is shown at 29. A grounded electrically conductive band 30 is provided underneath the web for one electrical output connection from the transducer. The other output connection is shown at 31, applied to the lowermost extremity of the transducer.

A third form of transducer element bearing a close resemblance to the second variation is shown in FIG. 2C. In this third variation, the ground electroding 32 covers the upper half of the transducer. This causes the external liquid in which the transducer is immersed to be substantially field free, avoiding any problems from conductive or dielectric losses. This construction also avoids the need for electrical contacts on the upper transducer surface except at the perimeter of the web 35, and avoids interference with the sonic wave coupling by the transducers. The ground electroding to the upper surface of the web thus may act as one output electrode of the device. The lowermost extremity of the device is electroded as shown at 33 and provides the second output electrode. The polarization is shown at 36.

Of the three arrangements in FIGS. 2A, 2B and 2C, the first is of highest electrical impedance and has a maximum coupling coefficient (corresponding approximately to the k33 coefficient). The other two arrangements have an electrical impedance reduced by a factor of 2 and a coupling coefficient reduced by the square root of 2. Maximum energy transfer into and out of the transducer requires that these parameters enter into the total design.

Figure 4B:
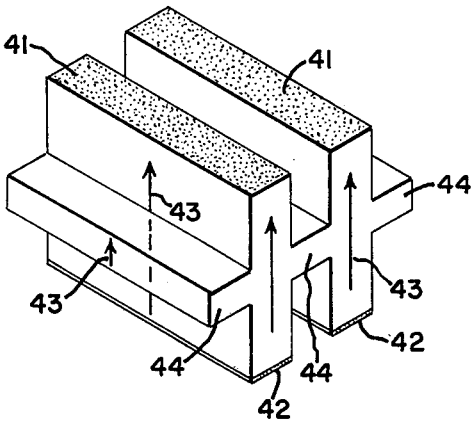
Figure 4C:
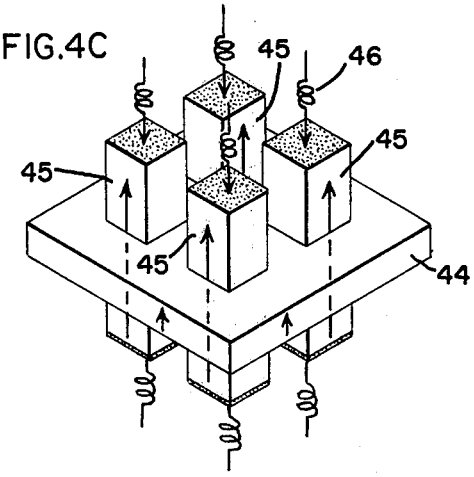

The longitudinally poled transducers may be formed in the manner shown in FIGS. 4A, 4B and 4C. In FIG. 4A, a relatively thin monolithic plate 40 of piezoelectric material is provided. A suitable material is one of the polycrystalline ferroelectric compositions containing a mixture of lead, zirconium and titanium oxides. The drawing tends to exaggerate the thickness of the array in relation to the length and width because only a two by two array is shown. As pointed out earlier, the total number of transducer elements will normally be much greater. After the thickness of the array has been machined to a close tolerance, the array is provided with electroding 41, 42, respectively, on the top and bottom surfaces. With the electroding in place, the array is placed in a polarizer. The polarizer temporarily elevates the temperature of the ferroelectric material to near or slightly above the Curie temperature, while a strong polarizing electric field is applied between the electrodes 41, 42 in the direction shown by the arrows 43.

The next operation is to shape the individual transducers within the array. The first step is to cut a succession of parallel slots in the top and bottom surfaces. The slots in the top and bottom are aligned, but stop short of the center of the piezoelectric plate. The material which is left at the bottom of the slots becomes the supporting web 44 for the individual transducers. When the first slotting operation is performed the configuration is as shown in FIG. 4B. A second succession of parallel slots orthogonal to the first slots is then cut into the upper and under surfaces of the plate 40. These complete the shaping of the individual transducers (45). The two cutting operations have left a significant amount of material at the base of the slots which completes the web 44 and which mechanically interconnects and supports the individual transducers at their nodal midsection as shown in FIG. 4C. The perimeter of the web also provides a convenient mounting flange for mounting the transducer array to the frame of the apparatus.

The final step in completing the transducers of FIG. 4C for use in a system of the type illustrated in FIG. 1 is the contact electroding. A basic problem in electroding is to avoid uncontrolled loading of the individual transducers. In FIG. 4C the electroding is equivalently represented as a plurality of resiliently biased contacts 46 contacting both the upper and lower ends of the transducers. This particular technique is quite satisfactory in many applications. When the upper face of the transducer is to be exposed to sonic waves, the contacting must avoid interference with sonic wave interaction. The upper contacts 46 may be connected to a common ground plane provided by a foil extending over the top surfaces of the transducers. The foil may be perforated to relieve the pressure between the inner and outer faces of the foil. AT 600 Khz, a foil having a thickness of from 1 to 2 mils has been used satisfactorily. One may also use an open mesh of very fine wire.

When a transducer array is made in the manner described above, the coupling between adjoining transducers is reduced to approximately −20 db. This reduction in coupling may be explained by the Poisson coupling mechanism. When the longitudinal expansion of the individual transducers occurs, this is accompanied by a corresponding contraction in cross section by virtue of a bulk property of the material which acts to reduce any changes in total volume. Thus, as the lengths of the transducers increase and decrease, a corresponding decrease and increase in the cross section occurs. This mechanical interaction, which is called Poisson coupling, is material dependent, being approximately one-third in solids. Thus, in converting the longitudinal vibrations in the transducer (perpendicular to the plane of the web 44), into vibrations parallel to the plane of the web and spreading through the web, a first Poisson coupling occurs, reducing the coupling of the communicated strains by the Poisson ratio. Once the strain has been communicated to the region of an adjacent transducer, to excite longitudinal vibration in that transducer perpendicular to the plane of the web, a further reduction in coupling occurs, equal to the Poisson ratio. Calculations and experimentation indicate that a net reduction of approximately 10 to 1 or 20 db will occur from one transducer to the adjacent transducers.

Assuming that the configuration is substantially loaded, which is a normal condition, when both ends of the transducers are immersed in fluid, additional improvement in isolation may occur due to the fact that the transmission of mechanical energy from one transducer to the next must fan out in a manner producing an approximately 6 to 1 energy reduction at the first rank of adjacent transducers and a 16 to 1 energy reduction in the second rank. A further control of the "cross talk" between adjacent transducers is in the web thickness. The web thickness is preferably kept below a maximum figure of $\lambda/8$ noted earlier.

The transducers illustrated in FIGS. 3A, 3B and 3C are polarized orthogonal to the principal mode of vibration. This has the advantage of allowing all electrical contacts to the electroding to be made in a nonloading nodal region. The transducer shown in FIG. 3A is polarized in both upper and lower sections in the direction indicated by arrows 37. These arrows are transverse to the principal vibrational mode of the transducer as indicated by the double-ended arrows at the transducer extremities. The transducers are electroded by a thin metallic layer deposited on the visible lefthand face and on the hidden righthand face of the upper and lower section as shown at 38. These electrode layers are normally very thin and provide negligible mechanical loading. While electrical contact may be made at any place on the electroded surface of 38, the mechanical loading is reduced by making the contact at the lowermost extremity of the transducer element as indicated at 39 on the web. The contact may be made with a small drop of solder attaching a fine wire.

The thin electroding layers have only a very small effect on the resonant frequency of the transducers, and since they may be applied with substantial uniformity, their effect upon increasing the frequency dispersion of large numbers of array elements is very small. The contacts, however, pose another problem. The amount of material in the bond, the loading effect of the wire, is a variable from contact to contact. To reduce the effect to a minimum, accordingly, it is important to apply them to a point on the transducers which has minimum effect on the resonant frequency. This dictates that the connection be made either at the base of the transducer near the web, or to a metallization on the web in contact with the transducer electroding. The transversely poled transducers, accordingly, which require no electroding at antinodal regions have more accurately reproducible resonant frequencies.

In the FIGS. 3B and 3C arrangements the lower section is polarized, while the upper section is left unpolarized. The upper section may be electroded on all surfaces to avoid external fields as shown in FIG. 3B, or left unelectroded as shown in FIG. 3C. The coupling coefficient exhibited by the transducer in FIG. 3A is the k31 coupling coefficient which is normally smaller than that of the k33 coefficient by a factor of about 2. Desirable piezoelectric materials have k33 coefficients from 0.65 to 0.75 and k31 coefficients from 0.30 to 0.40. The embodiments illustrated in FIGS. 3B and 3C have coupling coefficients which are reduced further by the square root of 2. The electrical impedance of the configuration in FIG. 3A is one-half the electrical impedance of the FIGS. 3B and 3C configurations. The electrical impedances of the transverse configurations are substantially lower than the electrical impedances of the longitudinally polarized configurations. This flows directly from the geometry of the device — i.e., the electrode separation and areas. Typically, the electrical impedance of the transversely polarized bar is less than one-sixteenth that of the longitudinally polarized bar, and the impedance may be further reduced by making the transducers more slender.

Figure 5A:
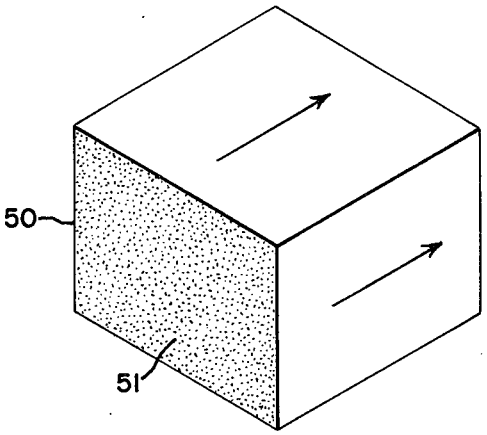
FIGS. 5A, 5B and 5C illustrate the fabrication of an array of transducers wherein the polarization is transverse to the mode of vibration.
Figure 5B:
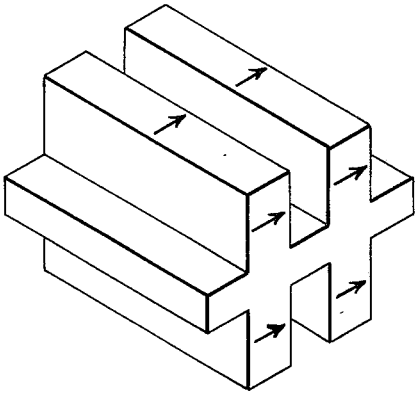
Figure 5C:
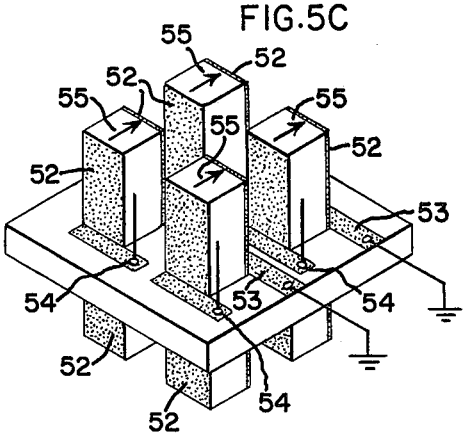

The transversely poled transducers illustrated in FIGS. 3A, 3B and 3C may be formed in the manner shown in FIGS. 5A, 5B and 5C. In FIG. 5A a thin monolithic plate 50 of piezoelectric material is provided. As pointed out in respect to the prior figures, the thickness dimensions of the plate are exaggerated because of the smaller than usual number of array elements depicted. After machining top, bottom and side surfaces, the array may be provided with temporary electrodes on the front and opposing surfaces as shown at 51 for purposes of immediately polarizing the piezoelectric plate. After polarizing they may be removed. If the transverse dimensions of the plate exceed several inches, however, it is preferable to polarize the transducers after forming is complete. After polarization, or surface machining if polarization is deferred, a first succession of slots is formed as shown in FIG. 5B and a second succession of slots is formed as shown in FIG. 5C. The permanent electroding is then applied to the left visible faces of the transducers and to the right hidden faces of the transducers as indicated by the reference numeral 52. The hidden faces may then be interconnected by a deposited conductive run 53 laid on the top and the bottom of the web. These interconnections are normally connected to ground. Individual electrical contacts may be made near the base of the transducers on the visible electrodes as shown at 54 with upper and lower sections of the transducers electrically parallelled.

If the individual transducers are electroded after the final slotting, as is desirable in large arrays, it is preferable to polarize the transducers in individual rows. This is normally done by alternating the direction of polarization between successive rows. This permits all the rows to be polarized in parallel with the polarizing potential alternately being raised and lowered as one proceeds through the array.

While the invention has been shown in several quite simple forms, it should be evident that very complex arrays may be assembled in the manner described. In general, the piezoelectric plate required for the smaller arrays may be readily formed in a single firing. After firing, and finishing of the top and bottom surfaces, individual transducers are formed by slotting the upper and lower surfaces of the plate. where large arrays are involved, as where the total dimensions approach a meter, the array will normally be assembled out of several substrates each of which are separately fired. In the case of an array having the dimensions of a meter, this might typically be formed out of 9 substrates.

The formation of the individual transducers and the web is also size dependent. In the smaller arrays, the slots are normally directly sawn out to form the transducers. In larger arrays, the individual transducers may be first roughly defined in a casting process and then finished to dimension in a machining operation.

The arrays in accordance with the invention have been described as operating in a passive or listening mode relying on sonic energy supplied by a separate transducer. The arrays themselves may also be used to provide a controllable source of illuminating sonic energy as is customary in sonar applications.

Since the array is formed of resonant elements, the usable spectrum is restricted to a range of frequencies in the vicinity of the fundamentals and usable harmonics of these elements. Using medium "Q" ceramic materials, a bandwidth of about 12 percent at the half power points is typical when both transducer faces are immersed in a liquid.

For maximum discrimination against undesired resonant modes, it is preferable that the transducers operate at their fundamental frequency with a central nodal region and antinodes at either extremity corresponding to a fundamental half wavelength longitudinal mode. However, higher frequency operation at the lower longitudinal overtones is also possible. Assuming a central nodal support, the first overtone is a three-halves wavelength longitudinal mode. If the nodal support is at an intermediate position, but with the nodal region displaced one-quarter wavelenbgth from one end, a one wavelength longitudinal mode may be employed. In arrangements operating in a longitudinal mode in a fundamental or lower overtone, the supporting web must remain at a node to achieve the essential decoupling between individual transducers.

In the simplest form, the web is a thin planar member, sufficiently thin to avoid supporting resonances at either the fundamental or any overtones of the frequency in use. In certain applications, the web need not be planar. For instance, it may be desirable that the web be in a spherical, parabolic or cylindrical configuration. When the configuration is spherical or cylindrical, the information derived from the individual transducers may be as readily processed by Fourier transformation equipment to form an image as when the web is in a planar configuration. The cylindrical configuration is particularly desirable for medical applications where the transducers should conform more closely to the outlines of a patient's body.

The lower limits of the thickness of the web are set by the requirement for mechanical integrity of the array. To a first order, disregarding electrical and mechanical losses, reducing the thickness of the web is of no effect in reducing cross talk. However, taking into account loss mechanisms and the fan-out of power in the web, the mechanical loading on the web arising from a liquid immersion of both faces, tends to enhance the decoupling between transducers as the web thickness is reduced. Thus, refined calculations and experience indicates that for maximum transducer decoupling the web thickness should be made as thin as is possible consistent with avoiding fragility in the overall array construction.

A particular advantage of the transducer arrays herein disclosed is that the provisions for mechanical and electrical coupling to the transducers may be mutually isolated for the separate optimization of each. Thus, the external face of the transducer array may be in a grounded conductive sheath exhibiting low mechanical loss. This reduces the external electrical fields and avoids any undesired electrical loading that would arise when the external fluid is an imperfect dielectric or an imperfect insulator such as sea water. This construction also avoids external electrical connections which would mechanically interfere with sonic waves impinging on the exposed extremities of the transducers. At the same time, the internal face of the transducer array is now free to provide for optimized electrical connections. For symmetry in mechanical loading of the external and internal quarter wave sections of the transducers, it is preferable that both internal and external faces of the array be immersed in a fluid having the same mechanical loading properties. However, the internal fluid may be selected to have optimal dielectric and insulative properties to avoid electrical losses.

While both longitudinally and transversely polarized transducers have been shown, the latter have the advantage of not requiring any mechanical loading electrical connections that would disperse the resonant frequencies of the individual transducers. The electroding of the transversely polarized transducer sections is a thin reproducible layer normally co-extensive with a pair of opposing lateral transducer faces bounding the polarized region and extending from an antinodal to a nodal region. These electrode layers are of sufficiently low mass and constancy of thickness as to have a like, but negligibly small effect on individual transducer frequencies. The smaller contact region to which a flying lead may be attached intrinsically has an appreciable and somewhat variable mass and elasticity. Since in the transversely polarized transducers, the contact may be located on the thin electrode layer at a nodal region on the transducer or on the web in proximity to the transducer node, the influence upon individual transducer frequency of a variation in mass or inflexibility of the contact is minimal.

What I claim as new and desire to secure by Letters Patent of the United States is:

1. A sonic transducer array for use in a liquid medium comprising:

a. a plurality of elongated piezoelectric transducers of substantially equal resonant frequency, designed to vibrate in a longitudinal mode with an intermediate nodal region and antinodes at either end, b. supporting means comprising:

1. a thin sheet-like web having a thickness of less than one-eighth wavelength; said transducers being supported by said web at their nodal regions in a position orthogonal to said web, spaced over said web at regular intervals; and 2. a frame attached to said web for mechanically supporting said transducers in position in said liquid medium, c. means for coupling the antinodal regions of the transducers on one face of said array to said liquid medium for mechanical interaction therewith, and d. electrode means coupled to said transducers for electrical interaction therewith.

2. A sonic transducer array as set forth in claim 1 wherein said transducers are spaced over said web at intervals substantially equal to one-half the wavelength of said sonic waves in said liquid medium.

3. A sonic transducer array as set forth in claim 1 wherein said transducers and said web are a part of a monolithic piezoelectric member.

4. A sonic wave transducer as set forth in claim 1 wherein both faces of said array are immersed in liquid media to equalize the mechanical loading between transducer halves.

5. A sonic array as set forth in claim 1 wherein said electrode means comprise:

a. a thin, extensive conductive layer of controlled, negligible mechanical loading, extending over external surface portions of said transducers in order to embrace a significant portion of the internal electrical field in said transducers, and b. a smaller less ectensive electrical contact for external connection to said conductive layer, exhibiting an unavoidable, random mechanical loading.

6. A sonic array as set forth in claim 5 wherein the liquid medium coupled halves of said transducers are covered with a thin conductive layer of minimum mechanical loading to reduce external electrical fields, eliminating individual electrical contacts to said last recited transducer halves, and wherein said electrode means are restricted substantially to piezoelectric coupling to the halves of said transducers on the other face of said array.

7. A sonic array as set forth in claim 6 wherein said transducers are transversely poled, said thin conductive layers being applied to a pair of opposing lateral surfaces of said transducers extending from the antinodal to the nodal regions and wherein said contacts are applied to said thin conductive layers near the nodal web juncture of said transducer to reduce mechanical loading.

8. A sonic transducer as set forth in claim 5 wherein said transducers are longitudinally poled and wherein one contact is applied to one extremity of each transducer.

9. A sonic transducer array as set forth in claim 8 wherein a second contact is connected to the other extremity of each transducer.

10. A sonic transducer array as set forth in claim 6 wherein the transducer halves on the other face of said array are transversely poled, said thin conductive layers being applied to a pair of opposing lateral surfaces of said last recited transducer halves, extending from the antinodal to said nodal regions and wherein said contacts are applied to said conductive layers near the nodal web junction to reduce mechanical loading.

* * * * *